United States Patent [19]

Troncoso, Jr.

[11] Patent Number: 4,705,015

[45] Date of Patent: Nov. 10, 1987

[54] COMPOUND BOW DRAW POSITION INDICATING DEVICE

[76] Inventor: Fernando Troncoso, Jr., 14090-6100 Rd., Montrose, Colo. 81401

[21] Appl. No.: 871,468

[22] Filed: Jun. 6, 1986

[51] Int. Cl.[4] ..... F41B 5/00

[52] U.S. Cl. ..... 124/24 R; 124/86

[58] Field of Search ..... 124/23 R, 24 R, 88, 124/90, 86

[56] References Cited

U.S. PATENT DOCUMENTS

| | | | |
|---|---|---|---|
| 3,486,495 | 12/1969 | Allen | 124/24 R |
| 3,499,414 | 3/1970 | Frydenlund | 124/41 A |
| 4,300,521 | 11/1981 | Schmitt | 124/23 R |
| 4,421,093 | 12/1983 | Stock | 124/86 |
| 4,461,267 | 7/1984 | Simonds et al. | 124/23 R |
| 4,512,326 | 4/1985 | Jarrett | 124/23 R |
| 4,542,732 | 9/1985 | Troncoso | 124/24 R |
| 4,562,824 | 1/1986 | Jennings | 124/23 R |
| 4,572,153 | 2/1986 | MacPherson | 124/88 |
| 4,612,906 | 9/1986 | Troncoso | 124/24 R |

*Primary Examiner*—Richard C. Pinkham
*Assistant Examiner*—Benjamin Layno
*Attorney, Agent, or Firm*—Donald E. Nist

[57] ABSTRACT

The compound archery bow assembly includes an inner cam-type compound bow having an elongated riser with handle and arrow window, a pair of flexible limbs with a pair of wheels rotatably secured to the limb tips. A box-shaped bracket is secured to the riser below the handle and extends rearwardly thereof, with a vertical bowstring behind the bracket, a rotatable cam mechanism including a pair of cam lobes secured to each other, rotatably secured in the bracket, wheel cables trained around the wheels and secured to opposite ends of the bowstring, and cam cables extending between the cam lobes and limb tips. The assembly also includes an improved drawcheck with a clicker component releasably secured to either the bracket or cam mechanism, and an activator component secured to the other one of the bracket and cam mechanism. The clicker component includes an inverted generally U-shaped mounting block with flexible flat or trough-shaped strip mounted on the flat horizontal or downwardly sloped top and extending out one rounded side thereof into the path of the activator component which may be a U-shaped fitting having an adjustable strip-flexing pin extending from one side thereof. As the bowstring is drawn, the pin and strip converge, the pin flexing and then releasing the strip to cause it to click at full draw. The drawcheck is simple and adjustable.

9 Claims, 7 Drawing Figures

COMPOUND BOW DRAW POSITION INDICATING DEVICE

BACKGROUND OF THE INVENTION

1. Field of the Invention

The present invention generally relates to archery bows and more particularly to an improved inner cam-type archery bow assembly having a novel clicker drawcheck mechanism.

2. Prior Art

Various types of compound archery bows have been devised to increase the archery arrow speed, its flatness of trajectory and consequent shooting accuracy, while reducing so-called archer's paradox (arrow flexing) and, most importantly the effort needed to hold the bowstring at full draw while aiming. Most such bows are based upon that described in U.S. Pat. No. 3,486,495 to Hollis Allen. A relatively new type of compound archery bow has been devised and is known as the "inner cam" type. Such a bow is described in U.S. Pat. Nos. 4,005,606, 4,300,521 and 4,461,267. That type of bow employs a pair of limb tip wheels and a bracket which extends rearwardly from the riser and rotatably supports a lobed cam mechanism which retains the wheel cables which connect to the bowstring. The lobed mechanism also is connected by cables to the limb tips. As the bowstring is drawn, the lobed mechanism rotates in a vertical plane between the bowstring and riser to provide the mechanical advantage and draw weight curve characteristic of compound bows.

With most compound bows, conventional clicker-type drawcheck devices are difficult to install and/or operate. Because of the plurality of cables adjacent to the arrow flight path, such path is narrow. This is particularly the case for inner cam-type bows. A conventional clicker which must be affixed to the side of the arrow window may extend into such flight path, even after clicking, and also may apply sufficient side thrust on the arrow to adversely affect the arrow's flight at the moment of release and thus further narrow and render erratic the available arrow flight path through the bow.

Accordingly, there is a need for an improved clicker type of drawcheck particularly adapted for use in inner cam-type compound archery bows, and there is a need for an assembly incorporating the drawcheck and the bow.

SUMMARY OF THE INVENTION

The improved inner cam-type compound archery bow assembly of the present invention satisfies all the foregoing needs. The assembly is substantially as set forth in the Abstract. Thus, the assembly includes an inner cam-type compound archery bow having a riser with handle and arrow window, a pair of limbs with wheels rotatably connected to their tips, a box bracket connected to the riser below the handle and extending rearwardly, a cam mechanism, including a pair of connected lobes secured to the bracket for rotation in a vertical plane, and a bowstring rearward thereof, the ends of which are connected to wheel cables which are connected to the lobes. The lobes are also connected by cables to the limb tips.

The drawcheck includes a clicker component and an activator component, one of which is attached to the bracket and the other of which is attached to a lobe of the cam mechanism. As the lobes rotate during drawing of the bowstring, the clicker component and activator component are positioned so that they converge until at full draw the activator component causes the clicker component to flex, then be released so as to make an audible click, whereupon the archer releases the bowstring, that is, shoots the arrow.

The clicker component is a flat or trough-shaped, preferably semi-circular in transverse cross-section, strip releasably secured to and protruding from one side of the horizontal or downwardly sloped top of a mounting block. The block preferably is generally inverted U-shaped, with a rounded or cut-away or relieved portion at that one side where the strip exits so as to prevent stressing of the strip during repeated flexing thereof. The block can be positively clamped to the bracket or lobe by a threaded screw, bolt or the like extending therethrough.

The activator component is an adjustable pin protruding from the side of a U-shaped fitting releasably attached to the bracket or lobe in the same manner as the block.

The drawcheck is fully and easily adjustable on the bow, is below the arrow flight path and is simple, inexpensive, durable and efficient. Further features of the invention are set forth in the following detailed description and accompanying drawings.

DRAWINGS

DETAILED DESCRIPTION

FIGS. 1, 2, 3 and 6

Figure 1:
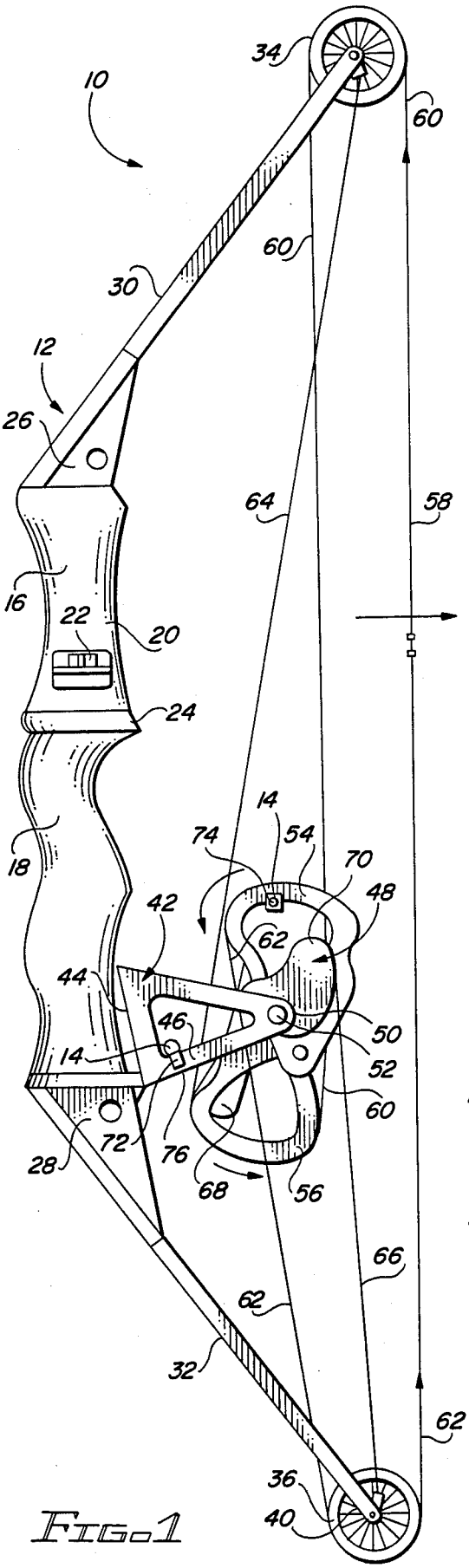
FIG. 1 is a schematic side elevation of a preferred embodiment of the improved inner cam-type compound archery bow assembly of the present invention.

Now reffering more particuarly to FIG. 1 of the drawings, a preferred embodiment of the improved assembly of the present invention is schematically depicted therein. Thus, assembly 10 is shown which comprises an inner cam-type compound archery bow 12 having an improved drawcheck 14.

Bow 12 includes a generally vertical riser 16 having a handle 18 with an arrow window section 20 thereabove, which section 20 bears an arrow rest 22 above shelf 24. To the upper and lower ends 26 and 28, respectively, of riser 16 are connected. limbs 30 and 32, respectively, extending rearwardly therefrom and bearing wheels 34 and 36, mounted at their centers on free limb tips 38 and 40, respectively, for rotation in a forwardly and rearwardly extending vertical plane.

Bow 12 also includes a bracket 42, the front transverse plate end 44 of which is secured to riser 16 below handle 18. A pair of spaced, parallel, open-centered triangular plates 46 are connected to plate 44 and extend rearwardly thereof to form an open cage. Cam mechanism 48 is secured to the rear end 50 of bracket 42 by cross pin 52 for rotation in and around bracket 42 in a plane parallel to that of wheels 34 and 36. Mechanism 48 includes a pair of open-centered lobes 54 and 56 rigidly connected to each other and bearing cable-receiving tracks (not shown).

Vertical bowstring 58 is disposed behind mechanism 48 and its ends are releasably connected to wheel cables 60 and 62 which are trained, respectively, over wheels 34 and 36 and over lobes 56 and 54, respectively, being connected to said lobes. Two sets of cam cables 64 and 66 are connected, respectively, to fittings 68 and 70 on lobes 56 and 54, respectively, and to limb tips 38 and 40, respectively.

Figure 6:
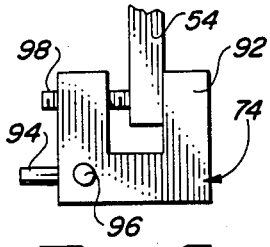
FIG. 6 is an enlarged schematic rear elevation, partly broken away, of the activator component of FIG. 2; and, FIG. 7 is an enlarged schematic rear elevation, partly broken away, of a modified version of the activator component of FIG. 2.

Drawcheck 14 comprises a clicker component 72 (FIGS. 2 and 3) and an activator component 74 (FIG. 6). In FIG. 1, clicker component 72 is shown releasably connected to an arm 76 of bracket side plate 46 and activator component 74 is shown releasably connected to lobe 54. It will be understood that these positions could be reversed, with component 72 connected to lobe 54 and component 74 connected to plate 46.

Figure 2:
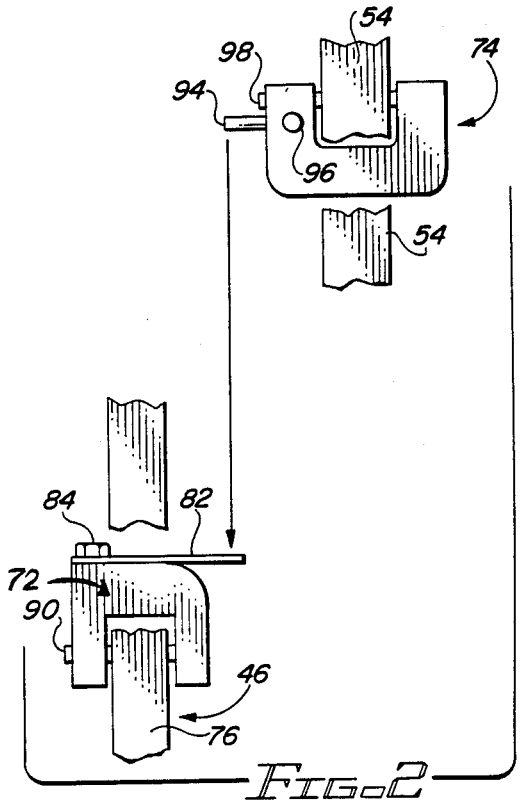
FIG. 2 is an enlarged schematic fragmentary rear elevation, partly broken away, depicting the path of convergence of the drawcheck components during drawing of the bowstring of the bow of FIG. 1.
Figure 3:
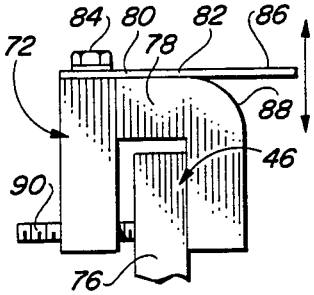
FIG. 3 is an enlarged schematic rear elevation, partly broken away, of the clicker component of FIG. 2.

Clicker component 72 comprises (FIG. 3) an inverted generally U-shaped block 78, the top 80 of which is generally horizontal and to which a flat, flexible resilient strip 82 of spring steel or other resilient metal, or the like or plastic or the like is releasably secured, as by a threaded screw 84 or the like. One end 86 of strip 82 extends laterally beyond block 78 and the side portion 88 of block under and most adjacent thereto is curved down so that when strip 82 is flexed by activator component 74, strip 82 will not be unduly stressed by binding against top 80 and eventually break. Block 78 is releasably secured to arm 76 by a threaded screw or bolt 90 or the like (FIGS. 2 and 3).

Activator component 74 comprises a U-shaped fitting 92 having a pin 94 adjustably and releasably secured therein, as by screw 96, pin 94 protruding from one side thereof for flexing strip 82. Fitting 92 is releasably connected to lobe 54 by a threaded screw 98.

Thus, drawcheck 14 is simple, inexpensive, durable, easily adjustable and effective. As bowstring 58 is drawn rearwardly by the archer, lobe 54 rotates forward, bearing component 74 with pin 94 towards component 72 bearing strip 82. The relative positions of components 72 and 74 can be adjusted so that at full draw of bowstring 58, pin 94 has pushed into end 86 of strip 82, flexing it until end 86 clears pin 94 and snaps back, making an audible click to signal to the archer to release the bowstring 58 in order to shoot the arrow.

If desired, the archer can first pull through the first click of drawcheck 14 and then critically aim while allowing his or her natural slight muscle relaxation to move the bowstring forward a slight bit sufficient to cause pin 94 to push past end 86 after flexing it in the opposite direction, to effect a second click, whereupon the archer shoots. This double click action is unique and is not possible with a conventional over-the arrow shaft clikcer device. Moreover, if for some reason the archer is unable at any time to achieve full draw, the arrow can merely be fired off (the bowstring can be released) without damage to the arrow. If this happened with a conventional clicker, the clicker blade would strip the feathers from the arrow and ruin the flight of the arrow. A further feature of the present invention is the easy almost infinite adjustability of the position of component 74 on lobe 54 for various draw lengths, whereas conventional clickers are difficult to adjust and have a limited range of adjustability.

FIG. 4

Figure 4:
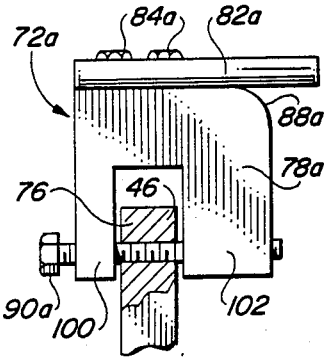
FIG. 4 is an enlarged schematic rear elevation, partly broken away, of a modified version of the clicker component of FIG. 2.

A modified version of the clicker component of the improved drawcheck of the invention is schematically depicted in FIG. 4. Thus, component **72*a* is shown. Portions thereof similar to those of component 72 bear the same numerals but are succeeded by the letter "a". Component 72*a* is identical to component 72 except that strip 82*a* is semi-circular in transverse cross-section, there are two lock screws 84*a* and block 78*a* has threaded bolt 90*a* extending all the way through legs 100 and 102 thereof so as to positively lock arm 46 in place on arm 76**.

FIG. 5

Figure 5:
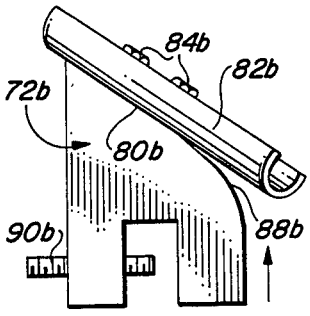
FIG. 5 is an enlarged schematic rear elevation of another modified version of the clicker component of FIG. 2.

A further modified version of the clicker component is schematically depicted in FIG. 5. Thus, component **72*b* is shown. Portions thereof similar to those of component 72 or 72*a* bear the same numerals but are succeeded by the letter "b". Component 72*b* is identical to component 72, including lock screw 90*b*, except that it bear strip 82*b* identical to strip 82*a*, a pair of lock screws 84*b* and a downwardly sloped top 80*b*, so that it is essentially a unidirectional clicker. When flexed in the up direction of the arrow in FIG. 5 and then released, strip 82*b* loudly clicks, while when flexed in the opposite direction, pin 94 of component 74 slips by strip 82*b*** without substantially flexing it, so that the click is nonexistent or small.

FIG. 7

Figure 7:
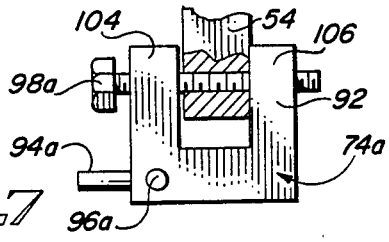

A modified verson of the activator component is shown in FIG. 7. Thus, component **74*a* is shown. Portions thereof similar to those of component 74 bear the same numerals but are succeeded by the letter "a". Component 74*a* is identical to component 74 except that bolt 98*a* extends all the way through legs 104 and 106 and lobe 54 to positively lock component 74*a* in place on lobe 54**.

Various other modifications, changes, alterations and additions can be made in the improved inner cam-type compound archery bow assembly of the present invention, its components and their parameters. All such modifications, changes, alterations and additions as are within the scope of the appended claims form part of the present invention.

What is claimed is:

1. An improved innner cam-type compound archery bow assembly, said assembly comprising, in combination:

a. a compound archery bow having
   i. an elongated riser, including a handle and an arrow window,
   ii. a pair of flexible limbs connected to opposite ends of said riser and extending rearwardly therefrom,
   iii. a pair of wheels rotatably secured to the free tips of said limbs,
   iv. a bracket secured to said riser below said handle and extending rearwardly therefrom,
   v. cam means rotatably connected to said bracket, vi. a bowstring disposed rearwardly of said cam means, vii. first and second wheel cables trained around said wheels, with opposite ends thereof connected to opposite ends of said bowstring and to opposite ends of said cam means, viii. first and second sets of cam cables secured to said means and to opposite ends of said limbs; and, b. a drawcheck comprising i. a clicker component having a mounting block releasably secured to one of said bracket and said cam means and bearing a flexible strip which gives an audible click when flexed and allowed to snap back, said block comprising an inverted generally U-shaped block with said strip mounted on the top thereof and extending laterally thereof at one side thereof, the portion of said block top adjacent said laterally extending portion of said strip being curved downwardly away from said strip to prevent excessive bending stress in said strip during clicking thereof; and ii. an activator component having a fitting adjustably attached to the other of said bracket and said cam means and bearing an activator pin adapted to flex said strip in order to effect said click, said clicker component and said activator component being positioned on said cam means and said bracket such that when said bowstring is drawn rearwardly to a desired full draw, rotation of said cam means effects contact and activation of said clicker component by said activator component to audibly signal said full draw.

2. The improved compound archery bow assembly of claim 1 wherein said strip is releasably secured to said block.

3. The improved compound archery bow assembly of claim 1 wherein said strip is generally semi-circular in transverse cross-section.

4. The improved compound archery bow assembly of claim 1 wherein said block is secured by a threaded bolt which passes through said block and said cam means or bracket to prevent separation upon release of said bowstring.

5. The improved compound archery bow assembly of claim 1 wherein the entire length of said top of said block is sloped downwardly and said strip is releasably mounted thereon, whereby flexing of said strip by said activator component in one direction causes a louder click then flexing of said strip in the opposite direction.

6. The improved compound archery bow assembly of claim 1 wherein said activator component comprises a generally U-shaped fitting having an adjustable pin extending from one side thereof to intercept said strip to effect said click.

7. The improved compound archery bow assembly of claim 6 wherein said pin is releasably secured in place by a set screw.

8. The improved compound archery bow assembly of claim 6 wherein said fitting is releasably secured to said cam means or said bracket by a threaded bolt passing through said fitting and cam means or bracket.

9. The improved compound archery bow assembly of claim 6 wherein said riser, cam means and bowstring extend generally vertically, wherein said bracket is a box open at the rear end, and wherein said cam means includes a pair of lobes pivotably secured in and extending, respectively, below and above said bracket for rotation in a vertical plane, wherein one of said wheel cables is trained around one of said lobes and the other of said wheel cables is trained around the other of said lobes, each said lobe bearing a fitting to which one set of said cam cables is attached.

* * * * *